US005928461A

United States Patent [19]

Kaufman et al.

[11] Patent Number: 5,928,461

[45] Date of Patent: Jul. 27, 1999

[54] RF PLASMA SOURCE FOR CLEANING SPACECRAFT SURFACES

[76] Inventors: David A. Kaufman, 1146 Diamond Ave., South Pasadena, Calif. 91030; Weldon S. Williamson, 6424 Seastar Dr., Malibu, Calif. 90265; John J. Vajo, 3574 Elm Dr., Calabasas, Calif. 91302

[21] Appl. No.: 08/857,368

[22] Filed: May 15, 1997

[51] Int. Cl.[6] ..... C23F 1/02

[52] U.S. Cl. ..... 156/345; 118/723 AN; 118/723 MA; 118/715

[58] Field of Search ..... 118/723 AN, 723 MA, 118/723 I, 723 IR, 723 E, 723 ER, 715; 156/345; 315/111.21, 111.41, 111.51

[56] References Cited

U.S. PATENT DOCUMENTS

| | | | |
|---|---|---|---|
| 5,418,431 | 5/1995 | Williamson et al. | 315/111.51 |
| 5,429,070 | 7/1995 | Campbell et al. | 118/723 R |
| 5,514,936 | 5/1996 | Williamson et al. | 315/111.51 |
| 5,537,004 | 7/1996 | Imahashi et al. | 315/111.21 |
| 5,628,831 | 5/1997 | Williamson et al. | 134/1.1 |
| 5,696,429 | 12/1997 | Williamson et al. | 315/111.51 |
| 5,824,602 | 10/1998 | Molvik et al. | 438/714 |
| 5,858,100 | 1/1999 | Maeda et al. | 118/719 |

*Primary Examiner*—Bruce Breneman
*Assistant Examiner*—Luz Alejandro
*Attorney, Agent, or Firm*—Terje Gudmestad; Georgann Grunebach; Michael W. Sales

[57] ABSTRACT

A plasma source uses radio frequency electromagnetic radiation to ionize and dissociate gas molecules into reactive species within a plasma generation tube and emits the species to react with and remove contaminants from surfaces on a spacecraft. The source of the radiation is an antenna brazed to the outside of the plasma generation tube. Permanent magnets ring the plasma generation tube within a metallic housing to generate a magnetic field. Pole pieces are provided to improve the strength of the field and to improve its uniformity and axial orientation within the plasma generation tube. A plenum and a gas diffusing element distribute gas entering the plasma generation tube.

18 Claims, 2 Drawing Sheets

RF PLASMA SOURCE FOR CLEANING SPACECRAFT SURFACES

TECHNICAL FIELD

This invention relates to radio-frequency (RF) plasma sources used for cleaning surfaces, such as those of lenses and thermal radiators, in space.

BACKGROUND ART

Reference is made to U.S. Pat. No. 5,418,431, assigned to the assignee of the present invention, illustrating a radio frequency (RF) plasma source. The previous design is for a lightweight, low power plasma source that produces a chemically reactive plasma that is capable of cleaning contamination from thermal radiators of spacecraft. The device produces ions having energy less than 20 eV. At this energy level, there is little risk of having the ions damage delicate substrate during a cleaning operation. The cleaning rate is such that operating the source a few times per month effectively prevents radiators from degrading significantly. In the previous system, one cleaner is mounted on each solar wing of a spacecraft; and the system weighs approximately 14 pounds.

The earlier design does not include a diffuser at the gas inlet. Without such an arrangement, the density in the plasma generation tube peaks along a longitudinal central axis of the tube. This is a disadvantage because RF waves from an associated antenna are able to dissociate only a small fraction of inlet gas into reactive species. The physics of the dissociation process is not fully understood, but recent research indicates that most high energy electrons in a helicon-type device such as the compact plasma cleaner are formed near the antenna around the plasma generation tube. High energy electrons sustain the plasma and are responsible for the dissociation reactions.

Without a diffuser, the gas density is lowest along the walls of the plasma generation tube where the high energy electrons are generated. By adding a diffuser the gas density is more uniform across the plasma generation tube. Therefore, more molecules are available near the plasma generation tube walls; and more high energy electrons (and therefore plasma) are produced.

In the prior design the plasma generation tube is formed of fused silica glass, and a semirigid coaxial cable inserted through a source housing supports the helical antenna around the tube. Because the plasma generation tube is silica, the antenna cannot be brazed to it. An antenna feed itself supplies the necessary external support for the antenna. Because of the external support, the antenna is larger than electrically necessary. The extra supporting material of the antenna and feed adds mass to the system. Securing a thinner antenna directly to the plasma generation tube and allowing the tube to support the antenna is a weight-saving solution.

The previously used feed includes a coaxial cable employing a teflon dielectric separating two coaxial conductors, and it presents an unbalanced feed to the balanced antenna design with no provision for cancelling out-of-balance ground currents. The teflon dielectric, while low-loss, represents a potential problem in that it may deteriorate due to proton bombardment while in geosynchronous orbit, altering the impedance match over time. The new strip transmission line design eliminates the need for a supporting dielectric, avoiding these potential problems.

In the prior design the structure of the plasma source relied on brittle magnets, held in compression, for support.

Furthermore, the design does not consider thermal expansion and shock effects. External structure assists the plasma source in surviving loads due to launch, solar panel deployment and pyroshock.

Ground-based reactive-plasma sources used for microelectronics processing are known in the literature. They differ from the present invention in two key respects, however. First, their size, mass, and power and gas consumption disqualify them from practical use in space applications. Second, most produce ions having sufficient energies to sputter many materials. This represents an important prohibition, especially for optical surface cleaning applications.

While the prior techniques function with a certain degree of efficiency, none disclose the advantages of the improved plasma source of the present invention as is hereinafter more fully described.

DISCLOSURE OF THE INVENTION

An object of the present invention is to provide an improved, small, light weight, dependable, highly efficient, RF-driven, reactive plasma source capable of using oxygen, water vapor or any of a plurality of other gaseous fuel to remove organic contamination from the surface of a body in space without damaging the surface.

Another object of the invention is to provide a plasma source capable of neutralizing localized electrical charge accumulation on the surface of a spacecraft.

An advantage of the present invention is that the plasma source thereof uses less gaseous fuel while maintaining a required cleaning capability.

Another advantage is that the plasma source minimizes power consumption, power losses and shorting hazards.

A feature of the present invention is that the plasma source thereof uses a ring of permanent magnets to establish a uniform, axially oriented magnetic field.

Another feature is that the plasma source has a diffuser to distribute gaseous fuel as it is input to a plasma generation tube, thereby enabling radio frequency radiation to ionize and dissociate a large portion of gas molecules within the tube into reactive species.

Still another feature is that the plasma source has a plenum defined therein to evenly distribute gaseous fuel before it is forced through the diffuser.

Yet another feature is that the plasma source thereof has a balanced input that minimizes feed matching difficulties.

Another feature is that the structural integrity of the plasma source enables it to survive loads due to launch, solar panel deployment and pyroshock.

In realizing the aforementioned and other objects, the radio frequency plasma source of the present invention includes a housing. Disposed inside the housing is an elongate plasma generation tube having input and output ends and a longitudinal central axis. A ring of permanent magnets is disposed within the housing to create a generally axially aligned magnetic field within the plasma generation tube. A pair of pole pieces are disposed at opposite ends of the permanent magnets. Each pole piece has a central aperture to receive the plasma generation tube.

A gas diffusing element extends across the input end of the plasma generation tube. An end member having a stepped central recess receives and supports the input end of the plasma generation tube. The recess forms, with the gas diffusing element, a plenum. The plenum distributes input gas across the diffusing element prior to the gas flowing therethrough and into the plasma generation tube.

An antenna is affixed to, and radiates electromagnetic energy into, the plasma generation tube to ionize gas flowing into it through the gas diffusing element. The antenna is fed by a strip transmission line.

A resilient plasma generation tube retainer having a central aperture is affixed to the housing. The portion of the retainer proximate the edge of the central aperture therein bears against the output end of the plasma generation tube, keeping the input end thereof seated within the stepped central recess of the end member.

The objects, advantages and features of the present invention are readily apparent from the following detailed description of the best mode for carrying out the invention when taken in connection with the accompanying drawings.

BRIEF DESCRIPTION OF THE DRAWINGS

A more complete appreciation of the invention and many of the attendant advantages thereof may be readily obtained by reference to the following detailed description when considered with the accompanying drawings in which like reference characters indicate corresponding parts in all the views, wherein.

BEST MODE FOR CARRYING OUT THE INVENTION

Figure 1:
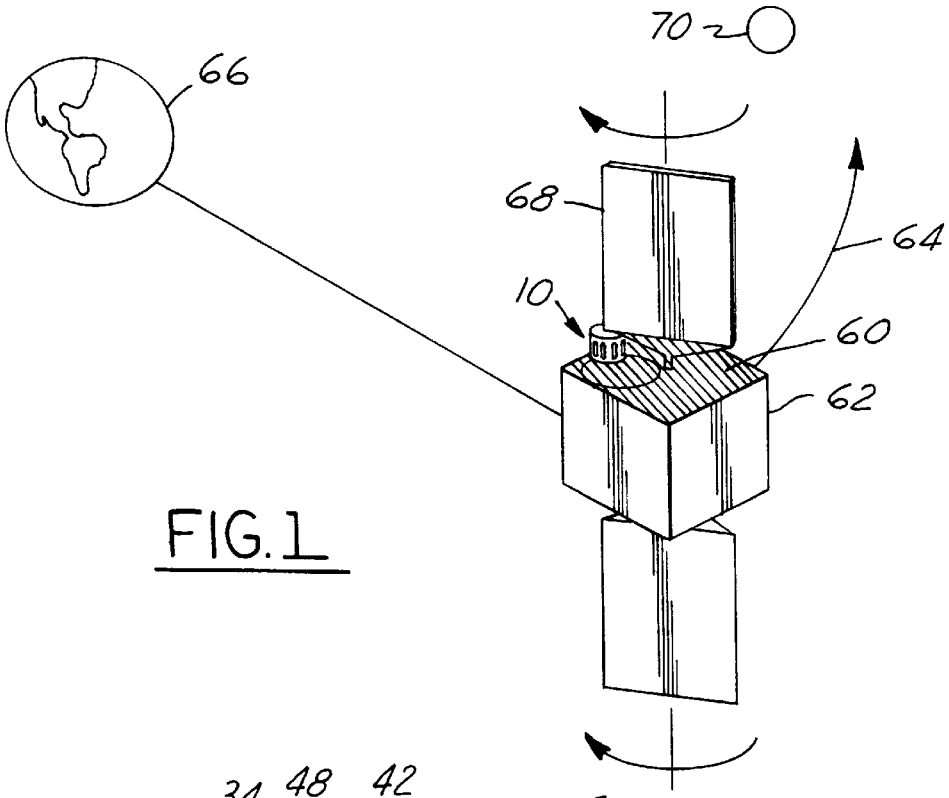
FIG. 1 is an environmental view showing a relative disposition of a plasma source with respect to a thermal radiator of a spacecraft in geosynchronous orbit around the Earth.

FIG. 1 of the drawing is an environmental view showing the relative disposition of a radio frequency (RF) plasma source, generally indicated by reference numeral 10, with respect to a thermal radiator 60 of a spacecraft 62 in geosynchronous orbit 64 around the Earth 66. The thermal radiator 60 cools the spacecraft 62 by efficiently radiating system heat while absorbing little solar energy. It accomplishes this by having high emissivity in the infrared wavelengths and low absorptance over the solar spectrum. A thermal radiator 60 typically includes a mosaic of silver-backed glass mirrors. In space, the mirrors become contaminated by outgassed hydrocarbons that photopolymerize under exposure to ultraviolet light.

A resulting contamination layer increases the solar absorptance of the mirrors, for example, from 0.08 at beginning of life (BOL) to 0.23 at end of life (EOL). With higher absorptance, a radiator absorbs more solar energy and can thus radiate less heat from the spacecraft. To compensate for the extra power absorbed at EOL, a thermal radiator 60 is significantly oversized. This, of course, adds weight and cost to the spacecraft.

The RF plasma source 10 is disposed on a yoke supporting a solar panel 68 so that the RF plasma source 10 directs a plume of generated plasma at right angles toward the thermal radiator 60 to react with and remove contaminants therefrom. The relative disposition of the RF plasma source 10 to the surface of the radiator 60 is such that, as the solar panel 68 rotates diurnally to face the Sun 70, the configuration of a cross-section of the plume and the surface area being cleaned are always substantially circular to maximize the latter area.

Figure 2:
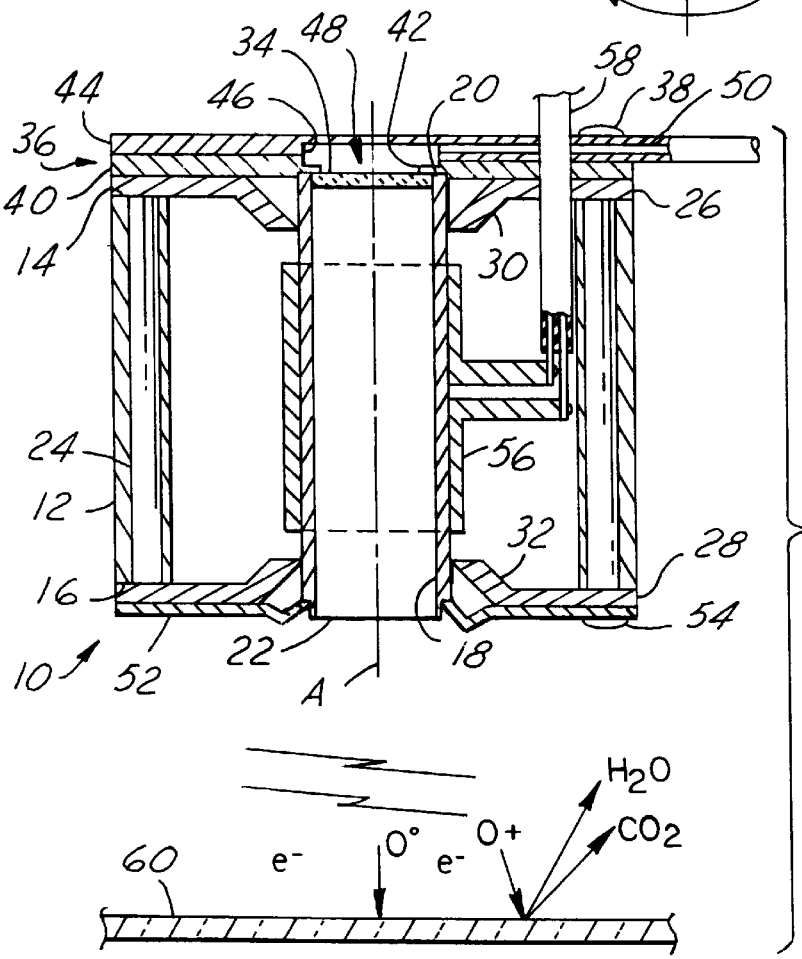
FIG. 2 is a schematic, sectional view of a radio frequency plasma source of the present invention and includes a sectional view of a spacecraft surface being cleaned.

FIG. 2 of the drawing includes a schematic representation of a preferred embodiment of the RF plasma source 10 of the present invention and includes a sectional view of a surface of the thermal radiator 60 being cleaned. The RF plasma source 10 includes a housing 12 having a generally right circularly cylindrical configuration and preferably formed of magnesium. The housing 12 has an input end 14, an output end 16 and a longitudinal central axis A.

Figure 4:
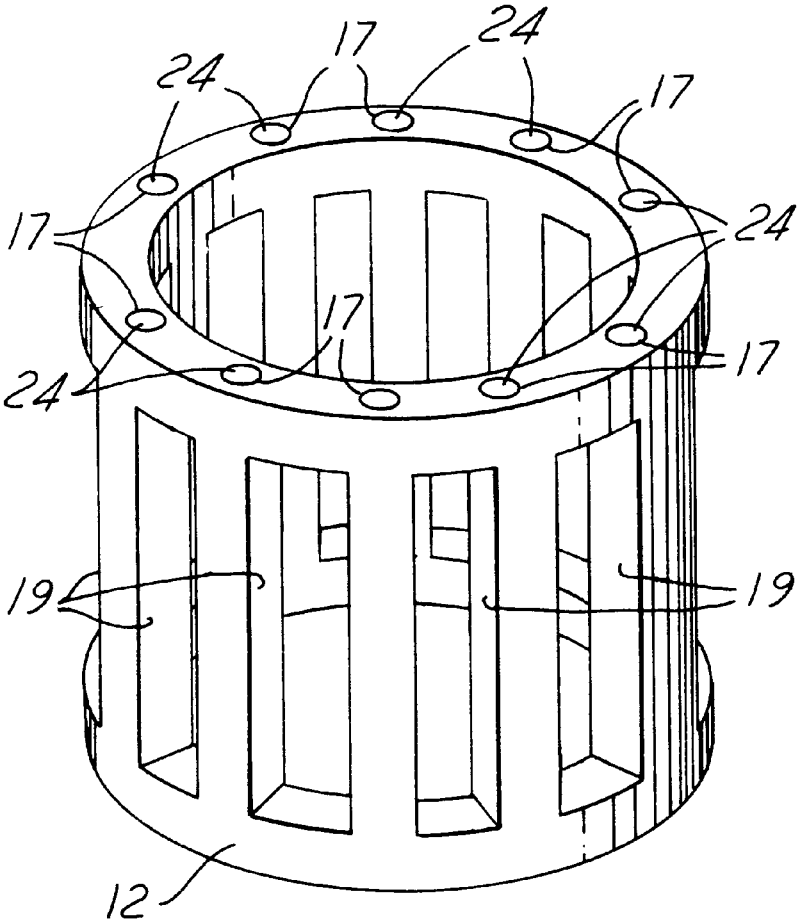
FIG. 4 is a perspective view showing details of a housing of the radio frequency plasma source of FIG. 2.

The housing 12 has defined therein a plurality of symmetrically disposed bores 17 extending parallel to and radially spaced from the longitudinal central axis A and extending from the input end 14 to the output end 16 of the housing 12. Also defined in the housing 12, between each bore 17, is an elongate slit 19. The slits 19 extend parallel to the longitudinal central axis A and from a position proximate, but short of, the input end 14 to a position proximate, but short of, the output end 16 of the housing 12. The configuration of the housing 12, indicating the disposition of the bores 17 and slits 19 therein, is shown in FIG. 4.

Figure 3:
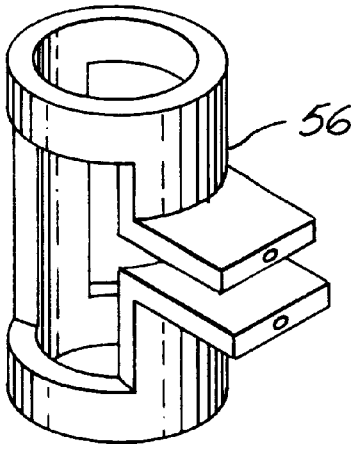
FIG. 3 is a perspective view showing details of an RF antenna of the radio frequency plasma source of FIG. 2.

An elongate plasma generation tube 18, having a right circularly cylindrical configuration, is disposed inside the housing 12. The plasma generation tube 18 has an input end 20 and an output end 22 and has a longitudinal central axis that is coincident with the central axis A of the housing 12. The plasma generation tube 18 is preferably formed of alumina so that the an antenna 56 can be brazed directly to it. The configuration of a representative antenna 56 is shown in FIG. 3.

A ring of permanent magnets 24, preferably formed of iron-nickel-borite or samarium-cobalt, are also aligned within the housing 12 with their magnetic poles aligned parallel to, but laterally spaced from, the central axis A to create a generally axially aligned magnetic field within the plasma generation tube 18. Each of the permanent magnets 24 is disposed within one of the plurality of bores 17. The number of permanent magnets 24 used is typically between 9 and 14 and is preferably 14. The slits 19 between the bores 17 are defined in the housing 12 to provide thermal radiation paths for cooling the permanent magnets 24.

An input end pole piece 26 and an output end pole piece 28, preferably formed of iron or iron-chromium-nickel, are disposed at respective ends of the housing 12. The pole pieces 26 and 28 are held in contact with respective ends of the permanent magnets 24. Each of the pole pieces 26 and 28 have a central aperture defined therein to receive the plasma generation tube 18. A preferably minority portion 30 and 32 of each of the respective pole pieces 26 and 28 surrounding the central apertures therein is obliquely angled toward the opposite pole piece. The pole pieces 26 and 28 shape the magnetic field to improve field strength and uniformity within the plasma generation tube 18.

A gas diffusing element 34 is mounted so that gas entering the input end 20 of the plasma generation tube 18 must flow through it. The gas diffusing element 34 is formed of a ceramic material, preferably ceramic felt. It offers resistance to gas flow to ensure a uniform density profile within the plasma generation tube 18.

An end member, generally indicated by reference numeral 36, is held in contact with the input pole piece 26 by a suitable fastening device such as one or more bolts 38. The end member 36 includes an inner end plate 40, preferably formed of magnesium, having a stepped central aperture 42. The input end 20 of the plasma generation tube 18 is received and supported by the stepped central aperture 42. The end member 36 also includes an outer end plate 44, also preferably formed of magnesium, having a central recess 46.

The central recess 46 defines, with the gas diffusing element 34, a plenum, generally indicated by reference numeral 48, therebetween. A radially disposed gas feed passage 50 communicates gas from an outside source thereof to the plenum 48, where the gas is distributed across the gas diffusing element 34 prior to flowing therethrough.

The plenum 48 and the gas diffusing element 34 ensure that the gas is distributed evenly within the plasma generation tube 18. This enables radio frequency radiation from the antenna 56 to ionize and dissociate a larger fraction of gas molecules into reactive species than it would if the gas was distributed in a less uniform manner. With the even distribution of gas within the plasma generation tube 18, cleaning operations require a much lower gas flow rate, and less fuel need be carried, than would be the case if either the gas diffusing element and/or the plenum were not used.

A resilient plasma generation tube retainer 52 having a central aperture is affixed to the housing 12 by a suitable fastening device such as one or more bolts 54. The retainer 52 is preferably formed of spring steel and resiliently bears against the output end 22 of the plasma generation tube 18, thereby keeping the input end 20 thereof seated within the stepped central recess 42 of the inner end plate 40.

The resilience of the plasma generation tube retainer 52 compensates for differential thermal expansion while providing necessary support for the plasma generation tube 18. The structural integrity of the plasma source 10 enables it to survive loads due to launch, solar panel deployment and pyroshock.

Then antenna 56 is affixed to the plasma generation tube 18. The antenna 56 is preferably formed of weight-reducing, silver-plated titanium. Since the plasma generation tube 18 is formed of alumina, the antenna 56 is preferably brazed thereto. Being affixed to the plasma generation tube 18, the antenna 56 requires no weight-adding external support and therefore can be much thinner and lighter.

The antenna 56 is fed from a source (not shown) of radio frequency electrical energy by a strip transmission line 58, formed of a gold- or silver-plated metal, preferably gold-plated titanium, and radiates electromagnetic energy to ionize gas flowing into the plasma generation tube 18 through the gas diffusing element 34. The strip transmission line 58 requires no dielectric support, as would a coaxial line typically used; and, having a balanced impedance, it minimizes impedance matching difficulties.

The radio frequency plasma source 10 operates at a power level less than 20, and preferably 15, watts and at a frequency of 100 to 130 MHz. It operates at a fuel flow rate of only 1 to 1.5, and preferably 1.2, standard cubic centimeters per minute (sccm); and it is capable of producing a chemically reactive plasma from oxygen, water vapor and other gases. During operation, electromagnetic waves are radiated by the antenna 56 in an axial magnetic field created by the strong permanent magnets 24. The electromagnetic waves ionize and dissociate the gas passing into the plasma generation tube 18 through the gas diffusing element 34.

The plasma formation mechanism is not well understood. We believe, however, that the plasma absorbs helicon waves through an electron damping process and that the exchange of energy between the waves and the electrons heats the electrons and thereby sustains the plasma.

The resulting ions are accelerated to an energy level of less than 20 eV and preferably to a 5 to 15 eV level. At such an energy level most materials do not sputter and are ejected from the output end 22 of the plasma generation tube 18. As shown in FIG. 2, if oxygen is used as a cleaning gas, oxygen atoms and ionized oxygen ($O^+$) are emitted toward an optical surface 60 to react with hydrocarbon contaminants thereon to form $CO_2$ and $H_2O$. If water vapor is used as a cleaning gas, oxygen atoms, oxygen ions, hydroxyl groups (neutral HO), and hydroxide ions ($HO^+$) are emitted toward an optical surface to react with hydrocarbon contaminants thereon to form $CO_2$ and $H_2O$. Nonreactive species such as $H_2O$ and $H_2$ compose the majority of the plasma plume.

To clean silicone contaminants effectively, fluorine-containing liquids, such as perfluoroacetic acid or hexafluoroacetone, are added to water used as fuel. Resulting plasma then contains reactive fluorene atoms and fluorene ions. The fluorene species etch silicone-based polymers more effectively than oxygen species and are thus capable of more rapidly cleaning contaminant layers having large amounts of silicone.

The compound preferably used has a vapor pressure similar to that of water at the operating temperature (about 20° C.) of a water tank in which they are stored. The two liquids thus evaporate at the same rate, and the composition of the fuel does not change as a function of time. An antifreeze agent such as alcohol, or ethanol, is also preferably added to reduce the freezing temperature of the liquid water. This reduces the freezing temperature of the fuel, allowing the tank to get colder during idle time, and requires less heater power.

While the best mode for carrying out the invention has been described in detail, those familiar with the art to which this invention relates will recognize various alternative designs and embodiments for practicing the invention as defined by the following claims.

What is claimed is:

1. A radio frequency plasma source, comprising:

a housing;

an elongate plasma generation tube disposed within the housing and having an input end, an output end and a longitudinal central axis;

a plurality of permanent magnets supported by the housing in a symmetrical ring about the longitudinal central axis of the plasma generation tube to create a generally axially aligned magnetic field therewithin;

a pair of pole pieces, each disposed at a respective end of the permanent magnets to shape the magnetic field to improve field strength and uniformity within the plasma generation tube;

a gas diffusing element extending across the input end of the plasma generation tube;

a gas feed passage for communicating gas from a source thereof through the gas diffusing element for ionization and dissociation within the plasma generation tube; and an antenna affixed to the plasma generation tube to radiate electromagnetic energy into the plasma generation tube and thereby ionize and dissociate the gas flowing into the plasma generation tube through the gas diffusing element.

2. The radio frequency plasma source as defined by claim 1, wherein the ring of permanent magnets includes from 9 to 14 permanent magnets.

3. The radio frequency plasma source as defined by claim 1, wherein the housing has defined therein a plurality of axially aligned bores, each of which receives and supports one of the plurality of permanent magnets.

4. The radio frequency plasma source as defined by claim 3, wherein the housing has defined, between and parallel to the bores, a plurality of slits therethrough to provide thermal radiation paths for cooling the permanent magnets.

5. The radio frequency plasma source as defined by claim 1, further including:

an end member having a stepped central recess defined therein to receive and support the input end of the plasma generation tube, the recess forming, with the gas diffusing element, a plenum wherein input gases are distributed across the gas diffusing element prior to flowing therethrough.

6. The radio frequency plasma source as defined by claim 5, wherein the end member comprises:

an inner end plate having a stepped central aperture defined therein to receive and support the input end of the plasma generation tube; and an outer end plate having a central recess and a gas feed passage defined therein to communicate gas from an outside source thereof to the plenum.

7. The radio frequency plasma source as defined by claim 1, wherein the pole pieces each have defined therein a central aperture to receive the plasma generation tube.

8. The radio frequency plasma source as defined by claim 7, further including a resilient plasma generation tube retainer having defined therein a central aperture and being affixed to the housing to bear against the output end of the plasma generation tube, thereby keeping the input end thereof seated within the stepped central recess of the end member.

9. The radio frequency plasma source as defined by claim 7, wherein a minority portion of each of the pole pieces surrounding the central apertures therein is inclined toward the other respective pole piece.

10. The radio frequency plasma source as defined by claim 1, wherein the plasma generation tube is formed of alumina.

11. The radio frequency plasma source as defined by claim 9, wherein the antenna is formed of silver plated titanium.

12. The radio frequency plasma source as defined by claim 11, wherein the antenna is brazed to the plasma generation tube.

13. The radio frequency plasma source as defined by claim 12, wherein the antenna is fed by a balanced, strip transmission line.

14. The radio frequency plasma source as defined by claim 1, wherein the housing is formed of magnesium.

15. The radio frequency plasma source as defined by claim 1, wherein the gas diffusing element is formed of ceramic felt.

16. The radio frequency plasma source as defined by claim 1, wherein fuel used as a source of input gas is water including water soluble, fluorine-bearing additives, plasma made therefrom containing reactive fluorene atoms and fluorene ions for cleaning silicone contaminants.

17. The radio frequency plasma source as defined by claim 1, wherein fuel used as a source of input gas is water including water soluble antifreeze to reduce the freezing temperature of the water.

18. The radio frequency plasma source as defined by claim 17, wherein the water soluble antifreeze is ethanol.

* * * * *